US005807116A

United States Patent [19]

Kitatani et al.

[11] Patent Number: 5,807,116

[45] Date of Patent: Sep. 15, 1998

[54] MULTIPOLAR ELECTRICAL JACK

[75] Inventors: Haremi Kitatani, Higashiosaka; Koji Matsumoto, Ikoma, both of Japan

[73] Assignee: Hosiden Corporation, Yao, Japan

[21] Appl. No.: 679,801

[22] Filed: Jul. 15, 1996

[30] Foreign Application Priority Data

Sep. 25, 1995 [JP] Japan ..... 7-246261

[51] Int. Cl.[6] ..... H01R 17/04

[52] U.S. Cl. ..... 439/63; 439/581

[58] Field of Search ..... 439/63, 581, 580, 439/675, 578

[56] References Cited

U.S. PATENT DOCUMENTS

| | | | |
|---|---|---|---|
| 3,601,776 | 8/1971 | Curl | 439/581 |
| 4,012,105 | 3/1977 | Biddle | 439/581 |
| 4,747,786 | 5/1988 | Hayashi et al. | 439/675 |
| 5,217,391 | 6/1993 | Fisher, Jr. | 439/578 |

*Primary Examiner*—Neil Abrams
*Assistant Examiner*—Tho Dac Ta
*Attorney, Agent, or Firm*—Jones, Tullar & Cooper, P.C.

[57] ABSTRACT

The present invention relates to a multipolar electrical jack (multipolar jack) which uses a multipolar electrical plug (multipolar plug) as a counter electrical connector. According to the present invention, even when a jack is of a multipolar type, the length of the jack can be shortened. The multipolar jack of the present invention is useful as a multipolar electrical connector to be used where space for insertion and ejection of the jack is required to be as small as possible, such as the case of an audio apparatus and a car navigation apparatus mounted on an automobile. In the multipolar jack of the present invention, a body is provided with an annular recess and a center recess positioned at the center of the annular recess of the body. Three poles are separately disposed on the annular recess of the body and the center recess, respectively. The poles are disposed in a distributed manner on the inner and outer peripheral faces of the annular recess of the body.

4 Claims, 6 Drawing Sheets

MULTIPOLAR ELECTRICAL JACK

BACKGROUND OF THE INVENTION

1. Field of the Invention

The present invention relates to a multipolar electrical jack (hereinafter referred to as "multipolar jack") which uses a multipolar electrical plug (herein-after referred to as "multipolar plug") as a counter electrical connector. Such a multipolar jack is useful as a multipolar electrical connector to be used in the case where a space for insertion and ejection of the multipolar plug is required to be as small as possible, such as the case of an audio apparatus or a car navigation apparatus which is to be mounted on an automobile.

2. Discussion of the Prior Art

FIG. 7 shows the main portions of a prior art multipolar plug P which is used as a counter electrical connector for the prior art multipolar jack used in an audio apparatus or the like. The multipolar plug P is a three-pole electrical plug in which a shaft portion 110 having three poles 111, 112, and 113 protrudes from an electrically insulative body 100. The three poles 111, 112, and 113 of the shaft portion 110 are arranged along the axial direction of the shaft portion 110 via insulation rings 121 and 122. In the above-described multipolar plug P, when the shaft portion 110 has a diameter D of 3.5 mm, the shaft portion 110 generally has a length L of about 14 mm. The pole 111 in the base position of the shaft portion 110 has a length L1 of about 4.5 mm, the pole 112 in the middle position has a length L2 of about 2.5 mm, and the pole 113 in the front end position has a length L3 of about 4.5 mm. In the case of a small-sized multipolar plug in which the shaft portion 110 has a diameter D of 2.5 mm, the reference length L of the shaft portion 110 is about 11 mm.

In a multipolar jack using as a counter electrical connector a multipolar plug such as the multipolar plug P exemplarily shown in FIG. 7 in which a plurality of poles are arranged on the body in the axial direction, a plurality of poles which respectively correspond to the poles of the multipolar plug P are required to be arranged on the body of the multipolar jack along the insertion direction of the multipolar plug.

In recent audio apparatuses, car navigation apparatuses, and the like, it is recommended that a space for insertion and ejection when a multipolar plug is to be inserted into or ejected from a multipolar jack located in the apparatus be as small as possible.

In the multipolar plug P shown in FIG. 7, the plurality of poles 111, 112, and 113 disposed on the shaft portion 110 are arranged along the axial direction. In such a case, if the number of poles is increased, it is necessary to increase also the length of the shaft portion 110 in accordance with the increased number of poles. This prevents the shaft portion 110 of the multipolar plug P from being shortened, thereby producing a limitation in the form of a decrease of the space for insertion into the multipolar jack. Also in a multipolar jack which is used as a counter electrical connector for such a multipolar plug, therefore, the length in the plug insertion direction is increased when the number of poles is increased, thereby producing a limitation in the form of a decrease in length.

SUMMARY OF THE INVENTION

It is an object of the present invention to provide a multipolar jack in which a plurality of poles are arranged along a plurality of virtual coaxial circles, thereby eliminating the necessity to increase the length of a pole portion even when the number of poles is increased.

The multipolar jack of the present invention is a multipolar electrical jack comprising a body and a plurality of poles, wherein:

an annular recess is formed in the body; a center recess is positioned at the center of the annular recess; a pole is disposed in the annular recess; and a pole is disposed in the center recess.

According to the multipolar jack of the present invention, even when the number of poles is increased, it is unnecessary to increase the length of the pole portion. According to the multipolar jack of the present invention, therefore, it is possible to decrease the space for location of the multipolar jack in an audio apparatus, a car navigation apparatus mounted on an automobile, or the like.

In the multipolar jack of the present invention, the pole disposed in the center recess is required to correspond to the pin pole of the multipolar electrical plug serving as a counter electrical connector which is to be inserted into the center recess, and the pole disposed in the annular recess is required to correspond to a sleeve pole formed of a cylinder which is coaxial with the pin pole of the multipolar electrical plug which is to be inserted into the annular recess.

In the multipolar jack of the present invention, the poles disposed in the annular recess may be plural so as to be disposed in a distributed manner on the inner and outer peripheral portions of the annular recess.

The other various characteristic configuration and function of the present invention will become apparent from the following description, starting first with the drawings.

DETAILED DESCRIPTION OF THE PREFERRED EMBODIMENT

Figure 1:
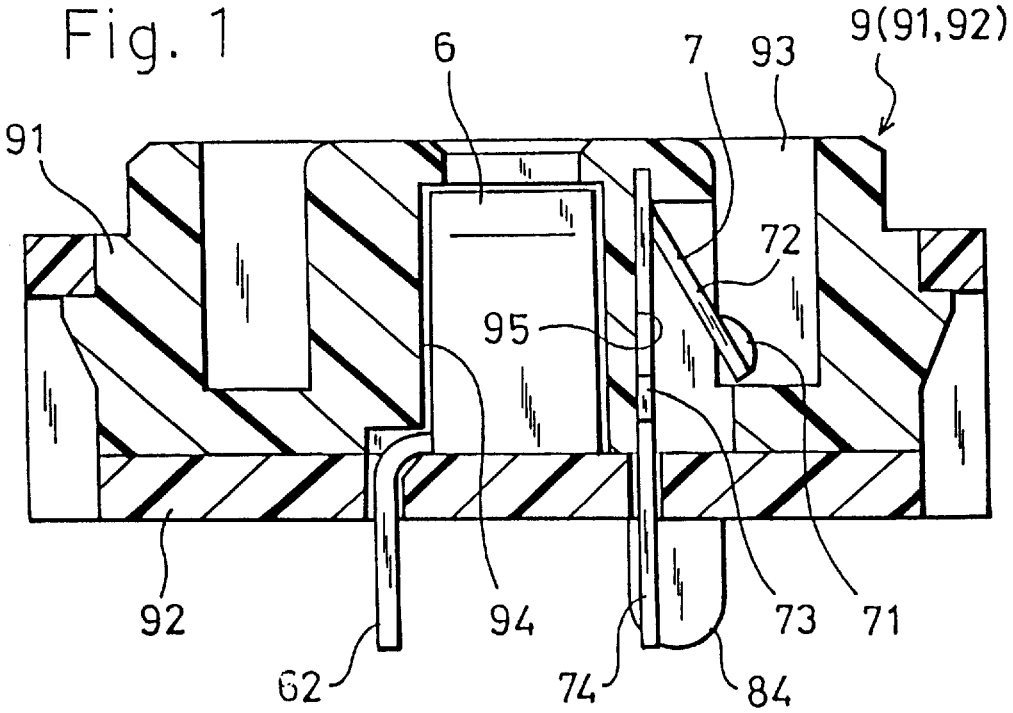
FIG. 1 is a vertical section view showing the internal structure of a multipolar jack according to an embodiment of the present invention.
Figure 2:
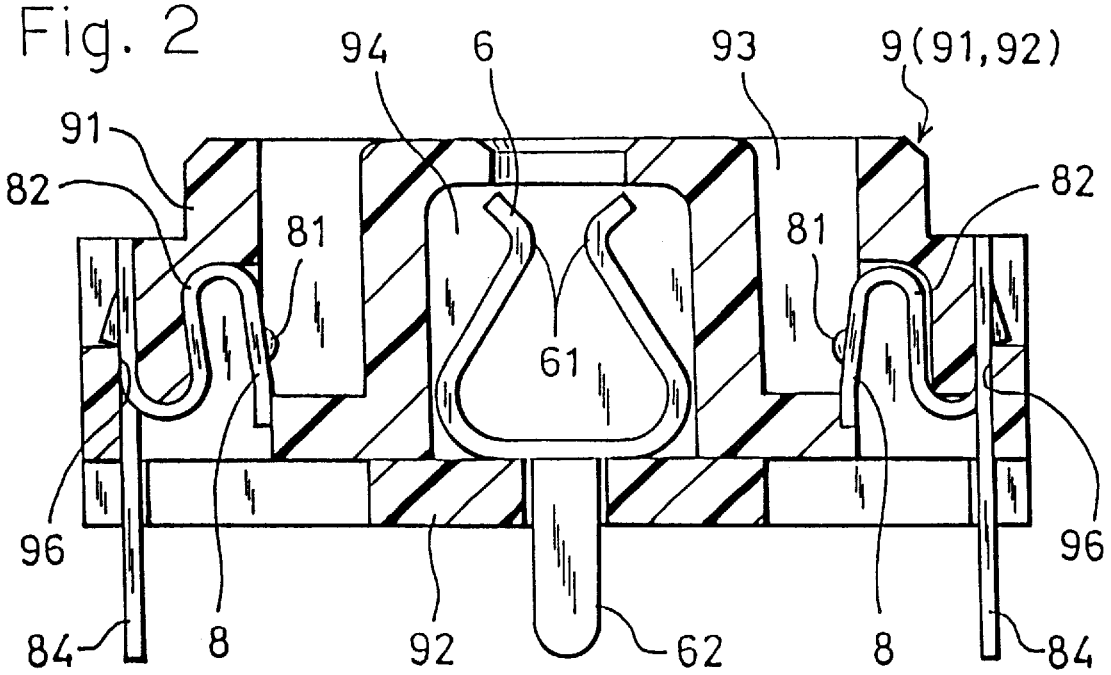
FIG. 2 is a vertical section view showing the internal structure of other portions of the multipolar jack of FIG. 1.
Figure 3:
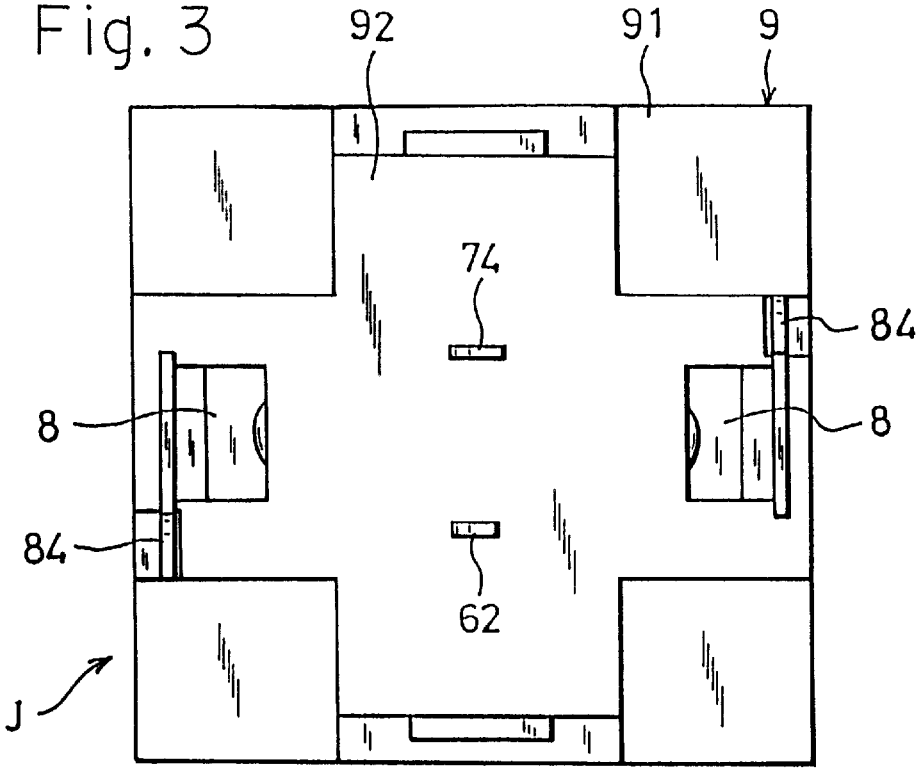
FIG. 3 is a bottom view of the multipolar jack of FIG. 1.

The multipolar jack J shown in FIGS. 1, 2, and 3 is of a three-pole type having a body 9 and three kinds of poles 6, 7, and 8. The poles 6, 7, and 8 incorporated into the body 9. The body 9 is made of a synthetic resin having a superior electrically insulative property. In the multipolar jack J of the illustrated embodiment, the body 9 comprises a body main unit 91 and a cover 92. The body main unit 91 comprises one annular recess 93 which is elongated along a virtual coaxial circle, and a center recess 94 positioned at the center of the annular recess 93.

In the multipolar jack J, the three kinds of poles are the center pole 6 disposed in the center recess 94, the first pole 7 disposed on an inner circumferential portion of the annular recess 93, and two second poles 8 and 8 disposed on an outer circumferential portion of the annular recess 93. The center pole 6 is formed of a spring member having a pair of contacts 61 which oppose each other. The center pole 6 corresponds to a pin pole 1 of a multipolar plug P which will be described later. A terminal 62 provided for the center pole 6 protrudes from the back face of the cover 92. The first pole 7 comprises a contact 71 in a front end portion of a raised piece 72 which is formed in the spring member. The contact 71 corresponds to a first sleeve pole 2 of the multipolar plug P which will be described later. The first pole 7 is pressingly inserted into a groove portion 95 formed in the body main unit 91, and an engagement pawl 73 provided for the first pole 7 is engaged with the body main unit 91, so that the first pole 7 is incorporated into the body main unit 91. A terminal 74 of the first pole 7 protrudes from the back face of the cover 92. Each of the second poles comprises a contact 81 formed at a front end portion of a meandering raised piece 82, which is formed as a spring member. The contact 81 corresponds to a second sleeve pole 3 of the multipolar plug P which will be described later. The second pole 8 is pressingly inserted into a groove portion 96 formed in the body main unit 91. An engagement pawl (not shown) provided for the second pole 8 is engaged with the body main unit 91, so that the second pole 8 is incorporated into the body main unit 91. A terminal 84 of the second pole 8 protrudes from the back face of the cover 92. The pair of second poles 8 are disposed at positions which are separated by 180 degrees from each other.

In the thus configured multipolar jack J, the first and second poles 7 and 8 are disposed in a distributed manner on the inner and outer peripheral portions of the annular recess 93, and the center pole 6 is disposed in the center recess 94. Therefore, the length of the multipolar jack in the insertion direction of a multipolar plug is smaller than that of a prior art multipolar jack in which poles corresponding to these poles are arranged in the insertion direction of a multipolar plug.

Figure 4:
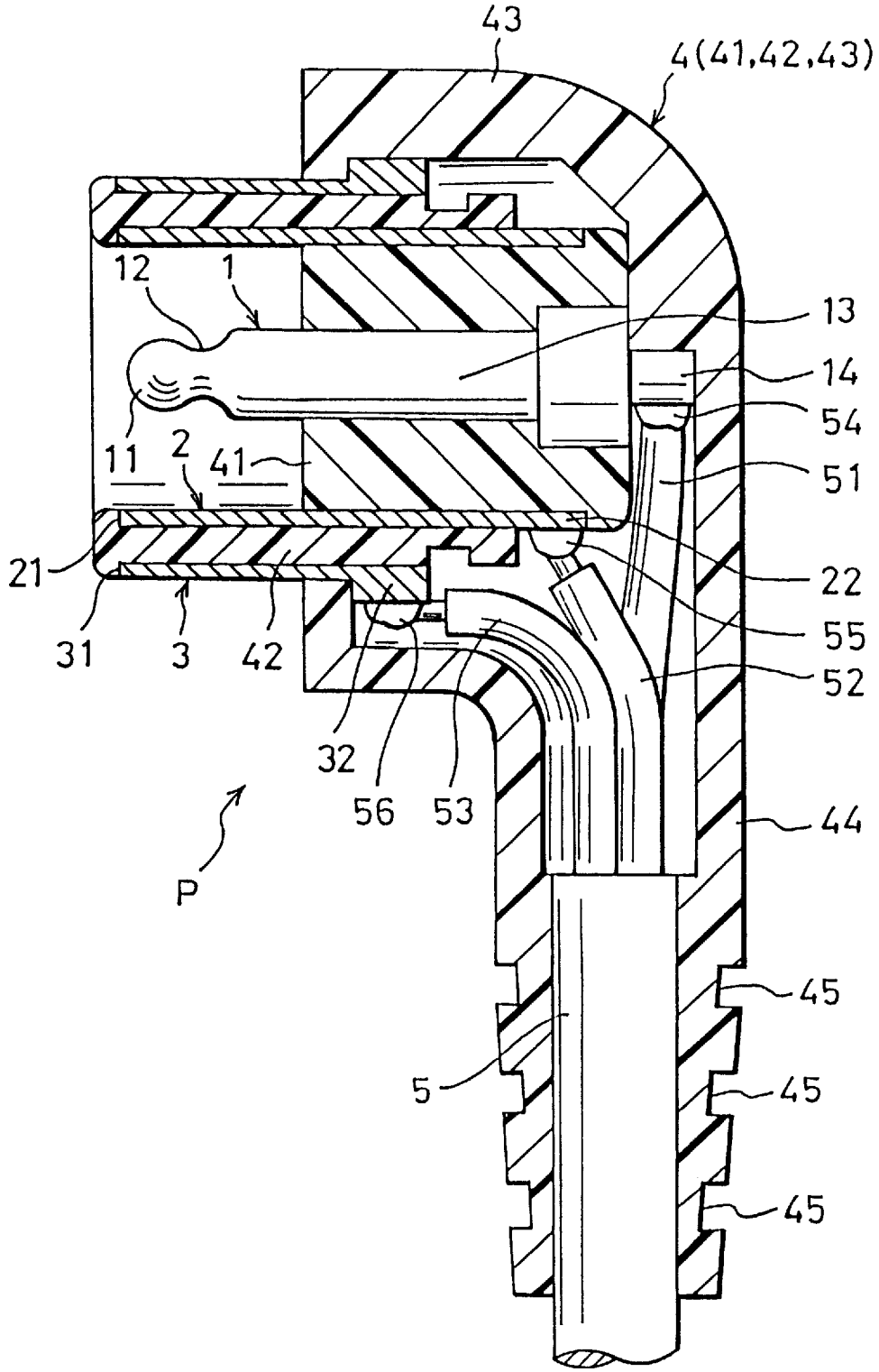
FIG. 4 is a longitudinal section view of a multipolar plug which is used as a counter electrical connector for the multipolar jack of FIG. 1.
Figure 5:
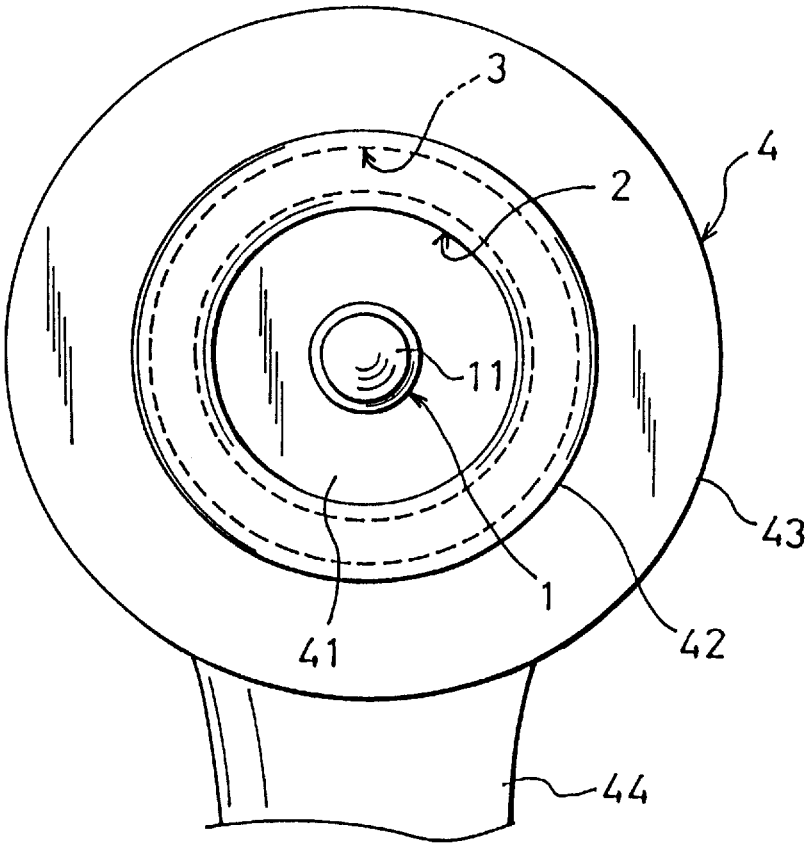
FIG. 5 is a front view of the multipolar plug of FIG. 4.

Referring to FIGS. 4 and 5, the multipolar plug P which is used as a counter electrical connector for the above-described multipolar jack will be described.

The multipolar plug P shown in FIGS. 4 and 5 is of a three-pole type and has three poles 1, 2, and 3. The poles 1, 2, and 3 protrude from the body 4 made of a synthetic resin having a superior electrically insulative property. As illustrated the multipolar plug P embodies the body 4 which comprises a first cylindrical insulator 41, a second cylindrical insulator 42 disposed around the first insulator 41, and a handle cover 43. A neck portion 44 which is elongated in a direction perpendicularly crossing the axial direction of the poles 1, 2, and 3 is continuously integrated with the handle cover 43. In order to provide the neck portion 44 with flexibility, a plurality of grooves 45 are formed so that portions where the grooves 45 are formed are thin.

The three poles are a pin pole 1, a first sleeve pole 2 formed as a cylinder, and a second sleeve pole 3 formed as a cylinder. The pin pole 1 has a reduced-diameter portion 12 which is adjacent to a spherical head portion 11. A base portion 13 of the pin pole is held in a press fit manner in the center of the first insulator 41. The first sleeve pole 2 is held in a press fit manner in an annular gap formed between the first insulator 41 and the second insulator 42. The second sleeve pole 3 is held in a press fit manner in a gap formed between the second insulator 42 and the handle cover 43. The first sleeve pole 2 overlaps the inner peripheral face of the second insulator 42, and the second sleeve pole 3 overlaps the outer peripheral face of the second insulator 42. With such a configuration, the first sleeve pole 2 and the second sleeve pole 3 are reinforced by the second insulator 42, so that they are not easily deformed, that is, they are superior in resistance to deformation. The pin pole 1, the first sleeve pole 2, and the second sleeve pole 3 are disposed in a mutually coaxial manner. The front ends 21 and 31 of the two sleeve poles 2 and 3 are located at the same level. The front end position of the pin pole 1 (i.e., the top of the head portion 11) is located at a level which does not protrude from the front ends 21 and 31 of the sleeve poles 2 and 3.

Terminal portions 14, 22, and 32 are disposed in the rear end portions of the pin pole 1 and the sleeve poles 2 and 3, respectively. Lead wire conductors 51, 52, and 53 are soldered to the terminal portions 14, 22, and 32, respectively. The reference numerals 54, 55, and 56 designate the soldered portions. The lead wire conductors 51, 52, and 53 pass through the neck portion 44 of the handle cover 43, in the form of one electric wire 5.

The embodiment of a multipolar jack having three poles has been described with reference to FIGS. 1, 2, and 3. In this invention, it is possible to constitute a multipolar jack having four or more poles. In other words, when annular recesses, the number of which corresponds to the number of poles, are provided in a coaxial manner and the poles are disposed in the annular recesses, it is possible to have a multipolar jack having a required number of poles.

Figure 6:
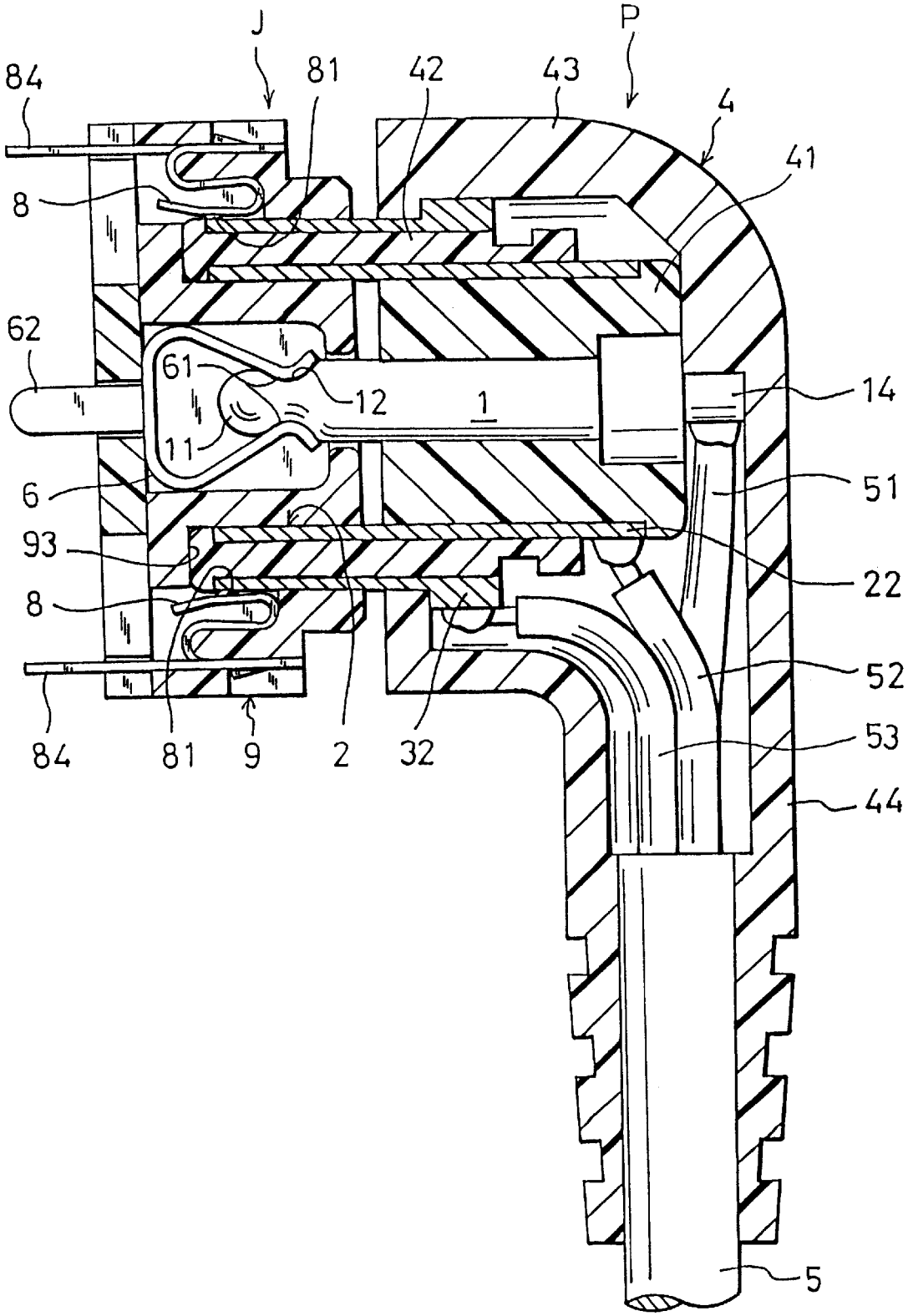
FIG. 6 is a section view showing the connection of the multipolar plug to the multipolar jack.
Figure 7:
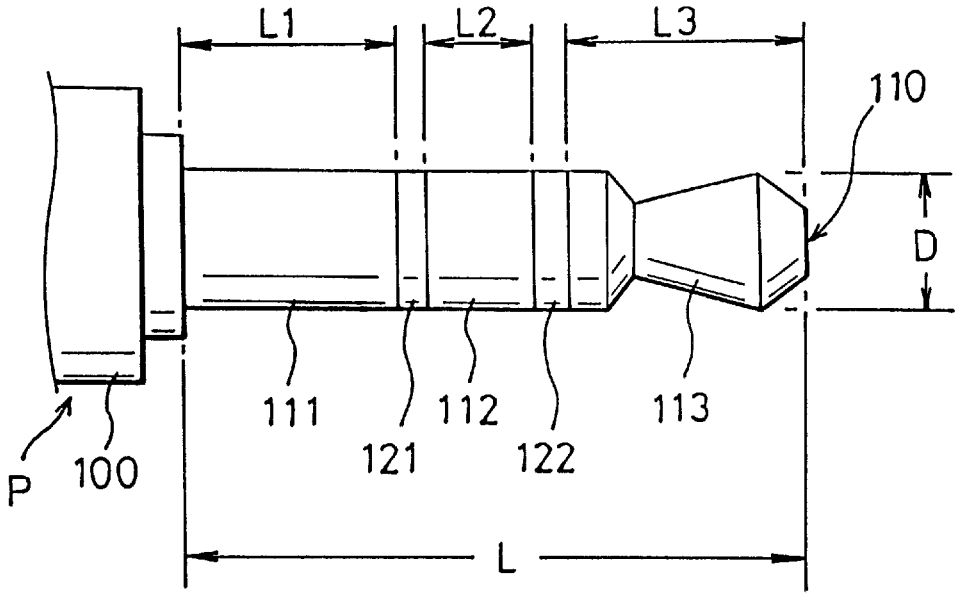
Fig. 7 (PRIOR ART)
FIG. 7 is a side view showing main portions of a multipolar plug which is used as a counter electrical connector for a prior art multipolar jack.

FIG. 6 is a section view showing a structure in which the above-described multipolar plug P is connected to the multipolar jack J. As apparent from the figure, the pin pole 1 of the multipolar plug P is inserted into the center recess 94 of the multipolar jack J. The pair of contacts 61 of the center pole 6 are fitted into and resiliently contacted with the reduced-diameter portion 12 of the pin pole 1. The contacts 61 are engaged with the spherical head portion 11, so that the multipolar plug P is prevented from slipping off. The first sleeve pole 2 and the second sleeve pole 3 of the multipolar plug P are inserted into the annular recess 93 of the multipolar jack J. The contact 71 of the first pole 7 which is not shown in the FIG. 6 is resiliently contacted with the first sleeve pole 2, and the contacts 81 of the second poles 8 are resiliently contacted with the second sleeve pole 3.

During the insertion of the multipolar plug P into the multipolar jack J, the head portion 11 of the pin pole 1 of the multipolar plug P expands the pair of contacts 61 of the center pole 6 of the multipolar jack J. Immediately after the head portion 11 passes over the pair of contacts 61, the contacts 61 are fitted into the reduced-diameter portion 12. At this time, a click feeling can be obtained.

What is claimed is:

1. A multipolar electrical jack, comprising:

a body; and a plurality of poles, wherein:

said body has an annular recess formed therein, and a center recess formed therein and positioned at the center of said annular recess, said annular recess having an inner circumferential portion and an outer circumferential portion; at least one first pole disposed in said annular recess and adjacent to said inner circumferential portion, at least one second pole disposed in said annular recess and adjacent to said outer circumferential portion and a pole disposed in said center recess, said at least one first pole and said at least one second pole each including a contact which protrude outward into said annular recess;

said pole disposed in said center recess corresponds to and receives a pin pole of a multipolar electrical plug which serves as a counter electrical connector; and both said at least one first pole and said at least one second pole being formed as cylinders coaxial with the pin pole.

2. The multipolar electrical jack according to claim 1, wherein a plurality of first poles are provided.

3. The multipolar electrical jack according to claim 1, wherein a plurality of second poles are provided.

4. The multipolar electrical jack according to claim 1, wherein a plurality of first and second poles are provided.

* * * * *